US005361471A

United States Patent [19]

Morioka et al.

[11] Patent Number: 5,361,471

[45] Date of Patent: Nov. 8, 1994

[54] SLIDE FASTENER COUPLING ELEMENT FORMING APPARATUS AND CUTTING PUNCH

[75] Inventors: Koitsu Morioka; Yasuhiko Matsuda, both of Toyama, Japan

[73] Assignee: Yoshida Kogyo K.K., Tokyo, Japan

[21] Appl. No.: 94,341

[22] Filed: Jul. 20, 1993

[30] Foreign Application Priority Data

Jul. 22, 1992 [JP] Japan ..... 4-195432

[51] Int. Cl.[5] ..... B21D 53/50

[52] U.S. Cl. ..... 29/33.2; 29/34 A; 29/410; 29/769; 83/78; 83/679

[58] Field of Search ..... 29/33.2, 33 K, 34 A, 29/408, 410, 766, 769; 83/78, 679

[56] References Cited

U.S. PATENT DOCUMENTS

| | | | |
|---|---|---|---|
| 1,947,956 | 2/1934 | Sundback | 29/410 |
| 2,141,200 | 12/1938 | Sundback | 29/769 X |
| 2,763,051 | 9/1956 | Firing | 29/33.2 |
| 2,804,677 | 9/1957 | Poux | 29/33.2 |
| 4,550,477 | 11/1985 | Iai | 29/33.2 |
| 4,974,305 | 12/1990 | Matsuda | 29/408 |

FOREIGN PATENT DOCUMENTS

| | | |
|---|---|---|
| 0028358 | 5/1981 | European Pat. Off. . |
| 0048807 | 4/1982 | European Pat. Off. . |
| 0048969 | 4/1982 | European Pat. Off. . |

*Primary Examiner*—Z. R. Bilinsky

*Attorney, Agent, or Firm*—Hill, Steadman & Simpson

[57] ABSTRACT

As it is intermittently supplied, a blank wire having a generally Y-shape cross section is cut into slices of a predetermined thickness by a cutting punch, which is fixed to the frame, and a coacting cutting die, which is reciprocatingly movable in the cutting direction. Then a bulge is formed on the head portion of the cut coupling element by a bulge forming die, which is connected with the forward end in stroke direction of the cutting die, and a coacting bulge forming punch, which is movable upwardly and downwardly. The cutting punch is equipped with preventing means on the upper side of the end of a blade for preventing the cut coupling element from jumping up from the blade, so that a bulge can be formed on the head portion reliably, without giving any damage to peripheral equipments.

5 Claims, 3 Drawing Sheets

SLIDE FASTENER COUPLING ELEMENT FORMING APPARATUS AND CUTTING PUNCH

BACKGROUND OF THE INVENTION

1. Field of the Invention

This invention relates to an apparatus for successively forming slide fastener coupling elements by transversely cutting a blank wire of a generally Y-shape cross section with repeated rolling, and more particularly to a slide fastener coupling element forming apparatus equipped with a preventing means for preventing with reliableness a freshly formed coupling element from jumping up obliquely from a cutting punch during cutting.

2. Description of the Related Art

Conventional slide fastener coupling element forming methods of the described type are chiefly divided into two groups: one in which generally Y-shape coupling elements are formed by successively punching a continuous length of flat belt-shape metal plate and, at the same time, bulges for successive coupling heads are formed one at a time (the resulting coupling elements will be hereinafter called "metal-plate coupling elements"); and the other in which individual coupling element blanks are obtained by threading a continuous length of blank wire through a plurality of rollers to shape it into a generally Y shape in cross section and then by successively cutting it into slices of a predetermined thickness using a coacting cutting punch and die, whereupon a bulge is formed at the individual coupling head of the coupling element using by a coacting bulge forming punch and die (the resulting coupling elements will be hereinafter called "wire coupling elements"). The former conventional method is exemplified by Japanese Utility Model Publication No. Sho 62-16886, and the latter conventional method is exemplified by Japanese Patent Publication No. Sho. 59-27667, corresponding to U.S. Pat. No. 4,388,751. Subsequently, the coupling elements obtained by either conventional method are individually collected loose, or are successively attached to a fastener tape on the same apparatus.

In forming the coupling elements from a blank wire, since the wire coupling elements formed in a generally Y-shape cross section is successively cut into slices of a predetermined thickness perpendicularly to the blank wire, the freshly formed coupling elements are smooth at their entire surfaces giving an excellent appearance, and it is possible to achieve a very high rate of production with no loss of material. This method is therefore most suitable for forming coupling elements.

However, according to the conventional method of forming wire coupling elements, when the blank wire having a Y-shape cross section is projected from the upper surface of the cutting die by a length corresponding to the thickness of a single coupling element as the blank wire is intermittently supplied through the insertion hole of the cutting die, the cutting die starts moving backwardly so that the projected length of blank wire is cut by a bifurcated blade of the cutting punch fixed to, for example, a frame, holding from opposite side surfaces at the root of cutting length. Then the cut coupling element is moved to the forming die where a bulge is formed on a head portion of the coupling element. The resulting coupling elements are individually collected from the forming die or are attached successively to the fastener tape continuously supplied at a predetermined pitch.

In the conventional method of wire coupling elements, when the blank wire is cut by the cutting punch as the cutting die moved backwardly, the cut coupling element held its opposite sides by the bifurcated blade tends to jump up obliquely forwardly from the blade of the cutting punch. If it is thus jumped up from the blade, the coupling element cannot be neatly received in the mold of the forming die not only so that desired forming is difficult to achieve but also that such coupling elements cannot be attached at a uniform pitch. This might damage peripheral equipments.

SUMMARY OF THE INVENTION

It is an object of this invention to provide a slide fastener coupling element forming apparatus in which a coupling element length cut off from a blank wire by a cutting die can be supplied to a subsequent bulge forming station reliably as it is held by a bifurcated blade of a cutting punch, causing an increased rate of production.

According to this invention, there is provided an apparatus for successively forming slide fastener coupling elements, comprising supplying means for supplying a blank wire of a generally Y-shape cross section intermittently at a predetermined pitch, a cutting die having an insertion hole for the passage of the blank wire W and movable back and forth in a direction of cutting the blank wire, a bulge forming die connected with a forward end in the stroke direction of the cutting die for forming a bulge for a coupling head portion of the coupling element, a cutting punch fixedly mounted on a frame and slidable on an upper surface of the cutting die, and a bulge forming punch situated upwardly of the bulge forming die and vertically movable toward and away from the bulge forming die, wherein the apparatus further includes preventing means situated on an upper end portion of a bifurcated blade of the cutting punch for preventing the freshly formed coupling element from jumping up obliquely from the blade during the cutting.

Preferably, a lower surface of the preventing means is spaced from a lower surface of the blade by a distance corresponding to the thickness of at least one coupling element. The preventing means may be a bridge member spanning between the end portions of the bifurcated blade or a pair of confronting projections slightly extending inwardly from the end portions of the bifurcated blade.

In this apparatus, while individual moving parts are actuated to perform the following operations in timed relation with one another, coupling elements are discharged with reliableness as they are formed one after another.

For example, as a first ram makes a forward stroke, a blank wire is conveyed longitudinally. At the end of the forward stroke of the first ram, the blank wire is stopped projecting from the cutting die by a predetermined length, i.e., a predetermined thickness of the coupling element. Then as the first ram makes a backward stroke, the projected portion of the blank wire is cut off by the cutting punch. During this cutting, the preventing means prevents the cut coupling element blank from jumping up from the blade of the cutting punch. Then in continuing backward stroke of the first ram, this predetermined length of the blank wire is moved reliably from the cutting die to the forming die.

Next, at the end of the backward stroke of the first ram, the forming punch together with the pressure pad is lowered to form a bulge on a head portion of the coupling element.

The individual formed coupling element is blown up away by, for example, air pressure and is then discharged out of the forming apparatus via a coupling-element catching pipe situated upwardly of the forming die. The discharged coupling elements are collected by a collecting unit outside the forming apparatus, and are then provided with a finishing treatment such as plating. Then the finished coupling elements are conveyed to a mounting station where they are mounted on and along one longitudinal edge of the fastener tape at a predetermined pitch by clenching in the usual manner.

Alternatively, the formed coupling elements may be attached successively to the fastener tape directly without collecting.

DETAILED DESCRIPTION

A preferred embodiment of this invention will now be described in detail with reference to the accompanying drawings.

The most significant feature of this invention is that a coupling element forming apparatus for forming coupling elements by cutting a blank wire of a generally Y-shape cross section and forming a bulge on a head portion of the individual coupling element is employs a preventing means for preventing the cut coupling element from jumping up from a cutting punch. This preventing means serves to hold the coupling element from opposite side surfaces by a bifurcated blade of the cutting punch while it is being cut, and also serves to move the cut coupling element to a forming die in a subsequent station where a bulge is formed on a head portion of the coupling element. Accordingly the following concentrates on the cutting punch having the preventing means.

The construction of this invention except the preventing means may be of the ordinary type disclosed in, for example, Japanese Patent Publications Nos. Sho 59-42903, ShO 59-51812 , corresponding to U.S. Pat. No. 4,387,495 and SHO 59-51813, corresponding to U.S. Pat. No. 4,550,477.

In the illustrated embodiment, the preventing means is employed in the slide fastener coupling element forming and mounting apparatus disclosed in Japanese Patent Publication No. Sho 59-51813. This invention should by no means be limited to this forming and mounting apparatus; for example, it may be applied to another type of coupling element forming apparatus in which the individual formed coupling elements are collected before being attached to the fastener tape.

Figure 1:
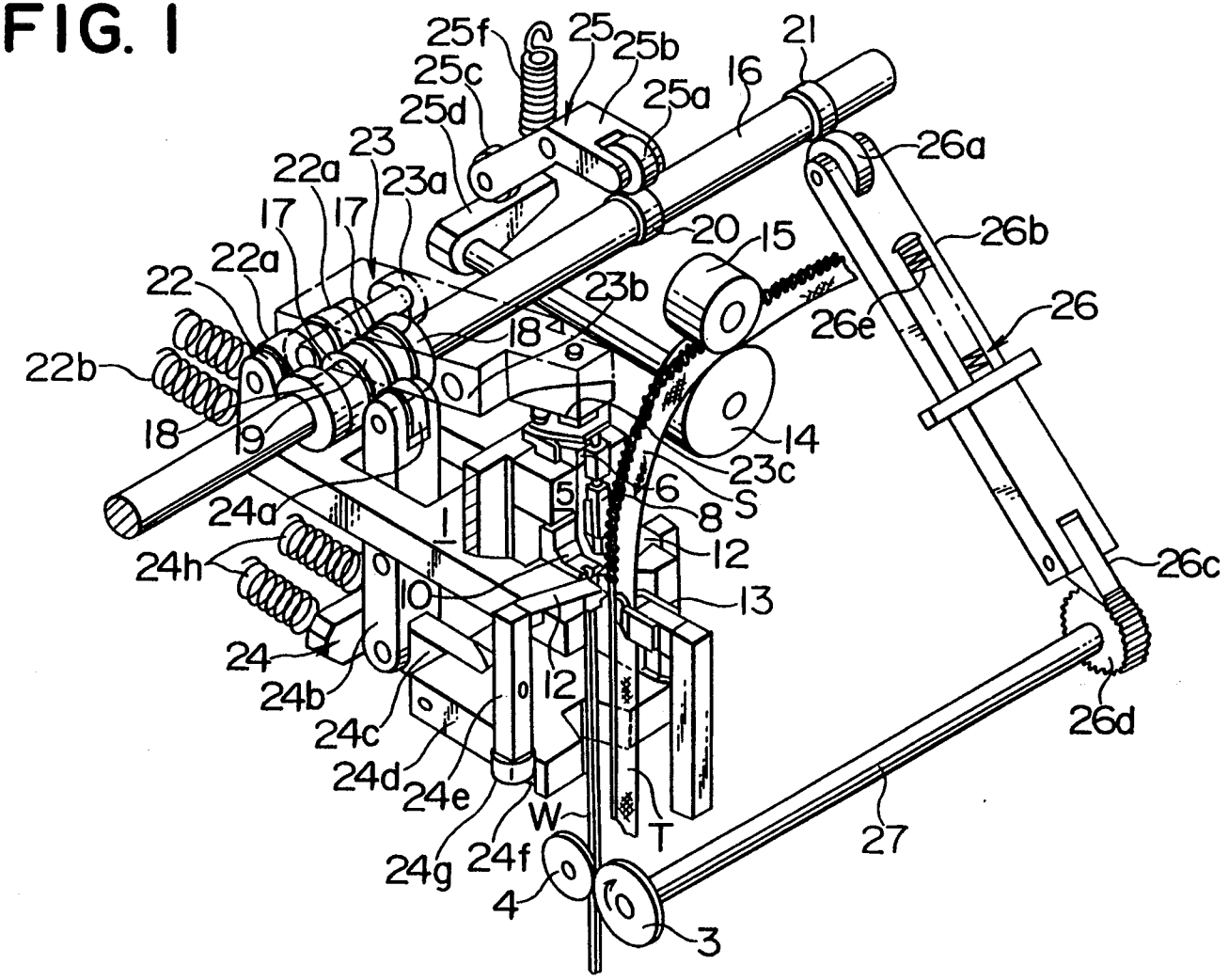
FIG. 1 is a fragmentary perspective view showing the main part of a coupling element forming and mounting apparatus according to a typical embodiment of this invention.
Figure 2:
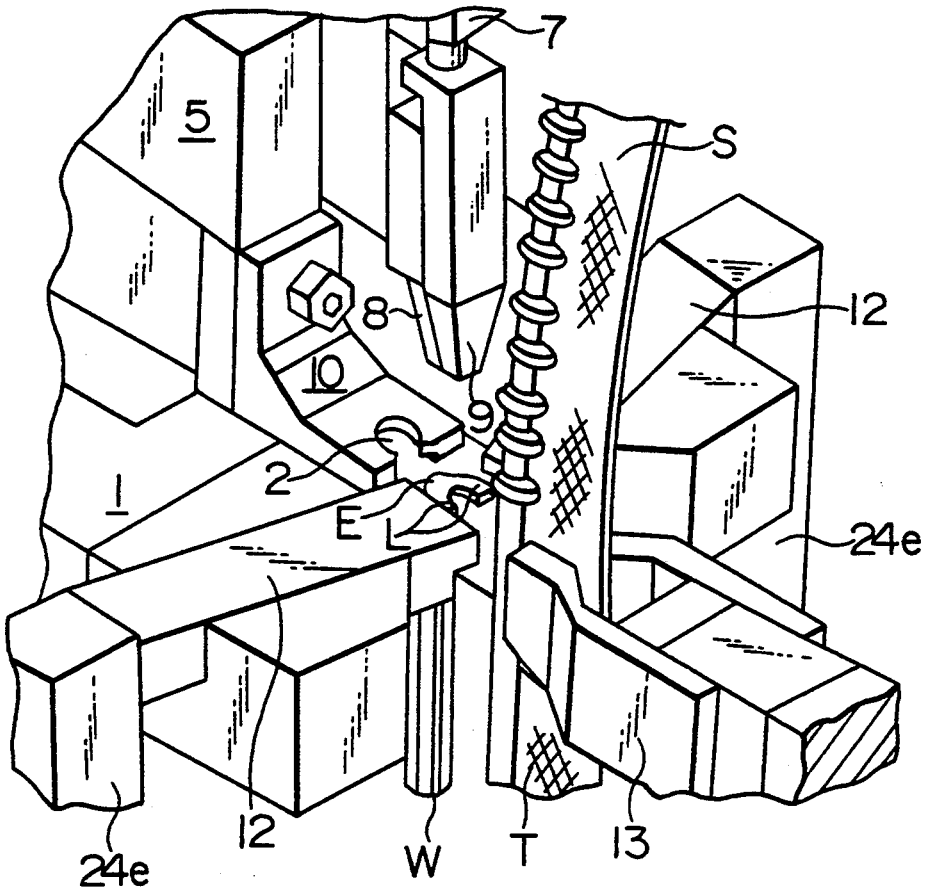
FIG. 2 is an enlarged perspective view of a cutting punch and its associated parts of the apparatus.

FIG. 1 is an enlarged perspective view of a coupling element forming station equipped with a coupling element jumping-up preventing means, which is feature part of this invention, and FIG. 2 is a perspective view of the main structure of the slide fastener coupling element forming apparatus. As shown in FIGS. 1 and 2, a first ram 1 is horizontally reciprocatingly movably mounted on a frame via a non-illustrated ram guide. A cutting die 2 is mounted on the forward end of the first ram 1, having a wire insertion hole for the passage of a blank wire W having a Y-shape cross section. A blank wire feed roller 3 and a guide roller 4 supply the blank wire W upwards intermittently at a predetermined pitch corresponding to the thickness of a coupling element E.

Figure 3:
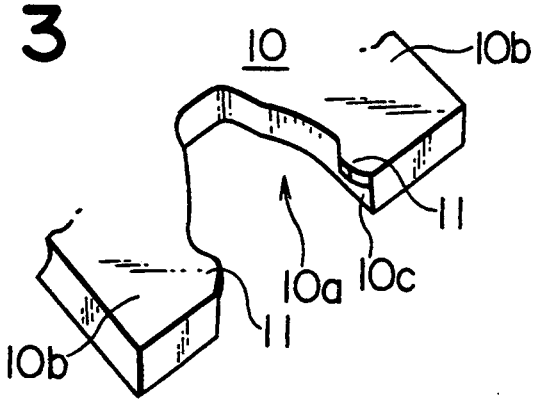
FIG. 3 is an enlarged perspective view of a blade of the cutting punch.

Upwardly of the front part of the first ram 1, in which a head portion of the coupling element is to be formed, a ram guide 5 is attached to a non-illustrated set plate supported by the frame. The ram guide 5 has a guide groove in which a second ram 6 is vertically movably received in timed relation with the horizontal reciprocating movement of the first ram 1. Attached to the front surface of the second ram 6 via a punch holder 7 are a forming punch 8 for forming a bulge on the head portion of the coupling element E and a pressure pad 9 for pressing the opposite leg portions L, L of the coupling element E while the bulge is being formed. Further, a cutting punch 10, which is feature part of this invention, is fixed to the lower end of the ram guide 5 so as to frictionally contact the upper surface of the first ram 1. The cutting punch 10 has a generally L shape as shown in FIG. 2 and has at its end a bifurcated blade 10*a*. FIG. 3 is a more enlarged perspective view of the blade 10*a*. As is apparent from FIG. 3, the bifurcated blade 10*a* has a pair of confronting arms 10*b*, 10*b* with a pair of right and left open ends for holding the blank wire W from opposite side surfaces.

Figure 4:
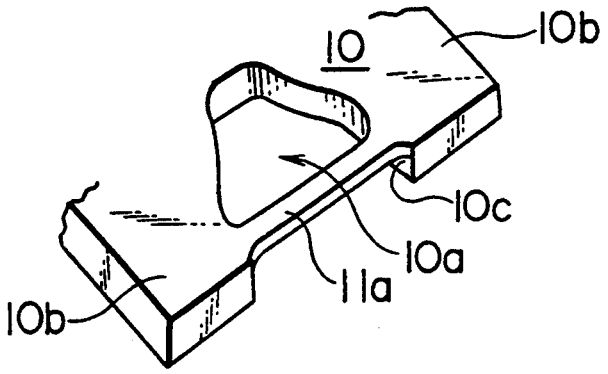
FIG. 4 is an enlarged perspective view showing a preventing means of one embodiment of this invention.

A pair of generally triangular projections 11, 11, which is one example of the preventing means of this invention, extend inwardly from the respective upper surfaces of the ends of the confronting arms 10*b*, 10*b* of the blade 10*a*. Each projection 11 defines on its lower side a hollow 10*c* contiguous to the inside surface of the blade 10*a* and having a thickness equal to the thickness of a coupling element. Each projection 11 may have a suitable length; but assuming that the thickness of the individual coupling element to be cut off the blank wire W is 0.75 mm, the length of the projection 11 should be preferably 0.15 mm in order not to interfere with peripheral parts. These values are only an illustrative example and may be changed, depending on the shape and size of the coupling element. Alternatively, the preventing means may be in the form of a bridge member 11*a* connecting the opposite projections 11, 11 with each other as shown In FIG. 4.

With the projections 11, 11, it is possible to prevent the coupling element from jumping up from the blade 10 while the blank wire W is being cut, and it is possible to provide a gap between the coupling element and the inside surfaces of the confronting arms 10*b*, 10*b*, so that the cut coupling element can be moved to the bulge forming station smoothly.

As shown in FIG. 1, a pair of side punches 12, 12 are situated at opposite sides of the forming punch 8 for clenching the opposite leg portions L, L of the coupling element E, on the head portion of which a bulge is formed, to attach the coupling element E to a fastener tape T.

As the fastener tape T is supplied to the apparatus from its lower side and is then guided by a tape guide 13, the coupling elements E are successively attached to the fastener tape T. The resulting slide fastener stringer S is then intermittently pulled upwardly by a stringer feed roller 14 and a pressure roller 15.

The foregoing moving parts are actuated by various cams, such as a first-ram drive cam 17, a forming-punch actuation cam 18, a side-punch actuation cam 19, a stringer feed cam 20 and a blank wire feed cam 21, and by various cam follower mechanisms 22–26 connected to the respective cams. All of the cams are mounted on a drive output shaft 16 situated on the back side of the first ram 1.

In the cam follower mechanism 22 associated with the first ram 1, a roller **22*a* resting on the first-ram drive cam 17 pivotally mounted on the back part of the first ram 1 is urged forwardly by a compression spring 22*b*. As the cam 17 is angularly moves, the first ram 1** stops for a predetermined time at each of predetermined forward and backward ends of the stroke.

The cam follower mechanism 23 for the forming punch 8 includes a roller **23*a* resting on the forming-punch actuation cam 18, a lever 23*b* pivotally connected at one end to the roller 23*a* and at its central portion to the frame body, a pin 23*c* attached to the other end of the lever 23*b* and contacting the head of the second ram 6, a non-illustrated compression spring for returning the lever 23*b* to its original position. Inside the second ram 6 there is mounted a non-illustrated compression spring urging the second ram 6 upwardly; as the lever 23*b* is pivotally moved by the cam 18, the second ram 6** is lowered to return to its original position under the resilience of the non-illustrated compression spring.

The cam follower mechanism 24 for the side punches 12, 12 includes a roller **24*a* resting on the side-punch actuation cam 19, a downwardly extending lever 24*b* pivotally connected at one end to the roller 24*a* and at its central portion to the frame, a link 24*c* pivotally connected at its central portion to the other end of the lever 24*b*, a third ram 24*d* pivotally connected at its back portion to the front end portion of the link 24*c*, a pair of actuator levers 24*e* supporting on their upper portions the side punches 12, 12 and pivotally connected at their central portions to the frame, and a compression spring 24*h* mounted on the back end of the link 24*c* . As shown in FIG. 1, both sides of the front end portion of the third ram 24*d* have a pair of outwardly divergent cam surfaces 24*f*, whom a pair of cam receivers 24*g* formed on the lower ends of the actuator levers 24*e* are in contact with. As the third ram 24*d* is moved backwardly, the cam receivers 24*g* cause the actuator levers 24*e* to pivotally move to actuate the side punches 12, 12. The returning of the third ram 24*d* to its original position takes place by the compression spring 24*h***.

The cam follower mechanism 25 for the stringer feed includes, a roller **25*a* resting on the stringer feed cam 20 as shown in FIG. 1, a first lever 25*b* pivotally connected at one end to the roller 25*a* and at the other end to the roller 25*c* and at its central portion to the frame, and a second lever 25*d* angularly movable downwardly by the action of the roller 25*c* and urged upwardly by a compression spring 25*f*. The stringer feed roller 14, in which a one-way clutch (not shown) is mounted, is supported on the base end of the second lever 25*d*** for intermittently feeding the stringer S by its rotation in only one direction.

The cam follower mechanism 26 for the blank wire feed includes a roller **26*a* resting on the blank wire feed cam 21, a slider 26*b* pivotally connected at one end to the roller 26*a*, a ratchet 26*c* attached to the other end of the slider 26*b*, and a ratchet wheel 26*d* to be turned intermittently at a predetermined angular pitch in only one direction by the ratchet 26*c*. The ratchet wheel 26*d* and the blank wire feed roller 3 are connected to each other by a transmission shaft 27 so that the balnk wire feed roller 3 supplies the blank wire W intermittently. The returning of the slider 26*b* to its original position takes place by a compression spring 26*e***.

In the foregoing coupling element forming and mounting apparatus, the coupling element E is formed and attached to the fastener tape in the following manner.

At the end of the forward stroke of the first ram 1, the supplying of the blank wire W is terminated and a predetermined length of the blank wire W is projected from the cutting die 2. In the first half of this step, the preceding coupling element E has already been attached to the fastener tape T. Upon completion of this attaching of the preceding coupling element E and when the opposite side punches 12, 12 release the opposite leg portions L, L, the pulling up of the slide fastener stringer S will be started soon and, at the same time, the first ram 1 will start moving backwardly at the time when the head portion of the coupling element E is released from the non-illustrated forming die connected with the forward end of the cutting die 2. Therefore the attached coupling element E would be free from being caught by the forming die being moved backwardly by the first ram 1.

As the first ram 1 is moved backwardly, the blank wire W is cut by the cutting punch 10. The pulling up of the slide fastener stringer S is completed when the first ram 1 is moved backwardly. During this cutting, the blank wire W is held by the inside surfaces of the confronting arms **10*b*, 10*b* of the blade 10*a*, and the projections 11, 11 extending from the upper surface of the blade 10*a* prevents the coupling element E from jumping up obliquely from the blade 10*a* at the end of cutting. As a result, the coupling element E is kept reliably inside the confronting arms 10*b*, 10*b*** until it is moved to the non-illustrated bulge forming die.

Next, at the end of the backward stroke of the first ram 1, the forming punch 8 with the pressure pad 9 is lowered to form a bulge on the head portion of the coupling element. At that time, the side punches 12, 12 also are kept stopped and supporting the leg portions L, L of the coupling element E from opposite sides. On the midway of the forward stroke of the first ram 1, the side punches 12, 12 starts mounting the coupling element E on the fastener tape T, whereupon at the end of the forward stroke of the first ram 1, the first step will start for the next cycle.

In the foregoing embodiment, this invention is applied to a coupling element forming and mounting apparatus in which coupling elements are formed and then attached successively to a fastener tape. Alternatively, this invention may be applied to a dedicated forming apparatus for forming coupling elements which are to be individually collected outside the apparatus. Also various modifications may be suggested to the foregoing moving parts.

As is apparent from the foregoing description, according to this invention, partly since the wire coupling element forming method, which is excellent in rate of production, is adopted, and partly since the cutting punch is equipped with preventing means for eliminating a coupling element jumping-up while the blank wire is cut, it is possible to form a bulge on the head portion of the individual coupling element reliably, without damaging peripheral equipments, thus causing a stable continuous operation for a long period of time. Specifically, because of the preventing means, it is unnecessary to receive the cut coupling element in intimate contact with the bifurcated blade of the cutting punch like the conventional art, so that a clearance can be created between the coupling element and the inside surface of the bifurcated blade, thus assisting in setting the coupling element exactly in a predetermined posture on the forming die where a bulge is formed on the head portion of the coupling element.

What is claimed is:

1. An apparatus for successively forming slide fastener coupling elements, comprising supplying means for supplying a blank wire of a generally Y-shape cross section intermittently at a predetermined pitch, a cutting die having an insertion hole for the passage of the blank wire W and movable back and forth in a direction of cutting the blank wire, a bulge forming die connected with a forward end in the stroke direction of said cutting die for forming a bulge for a coupling head portion of the coupling element, a cutting punch fixedly mounted on a frame and slidable on an upper surface of said cutting die, and a bulge forming punch situated upwardly of said bulge forming die and vertically movable toward and away from said bulge forming die, wherein said apparatus further includes preventing means situated on an upper end portion of a bifurcated blade of said cutting punch for preventing the freshly formed coupling element from jumping up obliquely from said blade during the cutting.

2. A slide fastener coupling element forming apparatus according to claim 1, wherein a lower surface of said preventing means is spaced from a lower surface of said blade by a distance corresponding to the thickness of at least one coupling element.

3. A slide fastener coupling element forming apparatus according to claim 1 or 2, wherein said preventing means is a pair of confronting projections slightly extending inwardly from the upper end portion of said bifurcated blade.

4. A slide fastener coupling element forming apparatus according to claim 1 or 2, wherein said preventing means is a bridge member spanning between the the portions of said bifurcated blade.

5. A cutting punch to be applied to a slide fastener coupling element forming apparatus for successively cutting a blank wire of a generally Y-shape cross section transversely into slices of a predetermined thickness, wherein a blade of said cutting punch has a bifurcate shape such as to hold the blank wire on its side surfaces, and said cutting punch is equipped with preventing means on an upper end portion thereof for preventing the freshly formed coupling element from jumping up obliquely from said blade during the cutting.

* * * * *